US008960711B2

(12) United States Patent
Svensson

(10) Patent No.: US 8,960,711 B2
(45) Date of Patent: Feb. 24, 2015

(54) SKI BOOT

(75) Inventor: John E. Svensson, Vashon, WA (US)

(73) Assignee: K-2 Corporation, Seattle, WA (US)

( * ) Notice: Subject to any disclaimer, the term of this patent is extended or adjusted under 35 U.S.C. 154(b) by 31 days.

(21) Appl. No.: 13/316,408

(22) Filed: Dec. 9, 2011

(65) Prior Publication Data

US 2013/0147160 A1 Jun. 13, 2013

(51) Int. Cl.
*A63C 9/00* (2012.01)

(52) U.S. Cl.
CPC ..... *A63C 9/00* (2013.01)
USPC ..... 280/636; 403/112; 403/116; 36/24.5; 36/102; 36/117.3; 36/117.2; 36/117.1

(58) Field of Classification Search
None
See application file for complete search history.

(56) References Cited

U.S. PATENT DOCUMENTS

| | | | | |
|---|---|---|---|---|
| 4,231,169 | A | 11/1980 | Toyama | |
| 4,499,674 | A | 2/1985 | Olivieri | |
| 4,562,653 | A | 1/1986 | Salomon | |
| 4,651,445 | A | 3/1987 | Hannibal | |
| 4,839,972 | A | 6/1989 | Pack | |
| 4,998,358 | A * | 3/1991 | Girardelli | 36/117.3 |
| 5,066,036 | A | 11/1991 | Broughton | |
| 5,452,526 | A | 9/1995 | Collins | |
| 5,832,634 | A | 11/1998 | Wong | |
| 5,918,338 | A | 7/1999 | Wong | |
| 5,992,861 | A | 11/1999 | Piotrowski | |
| 6,065,228 | A * | 5/2000 | Begey et al. | 36/15 |
| 6,082,744 | A | 7/2000 | Allinger | |
| 6,168,184 | B1 | 1/2001 | Simonetti | |
| 6,202,326 | B1 | 3/2001 | Hauglin | |
| 6,216,366 | B1 * | 4/2001 | Donnadieu | 36/97 |
| 6,289,610 | B1 * | 9/2001 | Girard et al. | 36/117.2 |
| 6,685,213 | B2 | 2/2004 | Hauglin | |
| 6,782,642 | B2 | 8/2004 | Knoche | |

(Continued)

FOREIGN PATENT DOCUMENTS

| | | |
|---|---|---|
| DE | 33 18 181 A1 | 11/1984 |
| DE | 20 2009 004 813 U1 | 10/2009 |

(Continued)

OTHER PUBLICATIONS

International Search Report and Written Opinion mailed Feb. 21, 2013, issued in corresponding International Application No. PCT/US2012/068607, filed Jul. 12, 2012, 8 pages.

(Continued)

*Primary Examiner* — J. Allen Shriver, II
*Assistant Examiner* — Hilary L Johns
(74) *Attorney, Agent, or Firm* — Christensen O'Connor Johnson Kindness PLLC

(57) ABSTRACT

A ski boot comprises a sole portion (2) that is attached to one or more separate outsole elements (3, 4, 5) for location between the sole portion (2) and a ski binding. At least one of the outsole elements (3, 4, 5) is adjustably mounted on the sole portion (2) prior to a secure fixing of said outsole element (3, 4, 5) to the sole portion (2) by at least one fastener (13) so as to be adjustable in forward, rearward, lateral and medial directions relative to the sole portion (2) and so as to be rotatable clockwise and counter clockwise relative to a centerline of the boot. Preferably, at least one of the outsole elements (5) is adapted for attachment to the ski binding. Advantageously, a plurality of outsole elements (3, 4, 5) is provided that are adjustably mounted on the sole portion (2) independently of the other outsole elements.

18 Claims, 3 Drawing Sheets

(56) References Cited

U.S. PATENT DOCUMENTS

| | | | | |
|---|---|---|---|---|
| 6,964,118 | B2 * | 11/2005 | Parisotto et al. | 36/7.6 |
| 6,971,652 | B2 | 12/2005 | Bobbert | |
| 7,591,085 | B2 | 9/2009 | Hauglin | |
| 2002/0092207 | A1 * | 7/2002 | Girard et al. | 36/117.3 |
| 2005/0280221 | A1 | 12/2005 | Haugen | |
| 2005/0280222 | A1 | 12/2005 | Sauter | |
| 2008/0127523 | A1 * | 6/2008 | Hauglin | 36/117.2 |
| 2009/0113763 | A1 * | 5/2009 | Narajowski et al. | 36/117.3 |
| 2012/0151801 | A1 | 6/2012 | Miette | |

FOREIGN PATENT DOCUMENTS

| | | | |
|---|---|---|---|
| EP | 0 712 587 | A1 | 5/1996 |
| EP | 2250916 | A1 * | 11/2010 |
| FR | 2 336 152 | A1 | 7/1977 |
| FR | 2 358 117 | | 2/1978 |
| GB | 2 256 784 | A | 12/1992 |
| WO | 91/09547 | A1 | 7/1991 |
| WO | 99/21625 | A1 | 5/1999 |
| WO | 02/052969 | A1 | 7/2002 |

OTHER PUBLICATIONS

"Cross-Country Skiing," Wikipedia.org, Jun. 17, 2007, <http://en.wikipedia.org/w/index.php?title=Cross-country_skiing&printable=yes> [retrieved Jun. 20, 2007], 11 pages.

Hale, P., "NIS: A Revolution in Nordic Bindings," Skinny Skis C-Corp, Jan. 17, 2006, <http://www.skinnyskis.com/article.aspx?id=10003> [retrieved Jun. 20, 2007], 3 pages.

Muha, M., "Nordic Integrated System," NordicSkiRacer.com, Jan. 26, 2005, <http://www.nordicskiracer.com/Equipment/2005/NIS/NIS.asp> [retrieved Jun. 20, 2007], 5 pages.

"NIS—Nordic Integrated System," Madshus, n.d., <http://www.madshus.com/mhtemplates/Page.aspx?id=332> [retrieved Jun. 20, 2007], 2 pages.

* cited by examiner

SKI BOOT

BACKGROUND

The present invention relates to a ski boot.

A ski boot is a specialized form of footwear that is used in skiing to provide a way of attaching the skier's feet to his/her skis via ski bindings. The ski boot should position the skier's body over the ski properly. Some skiers have to stop skiing as a result of knee, hip or ankle problems because they are not able to adjust the position of the ski relative to the boot to suit their body's natural geometry. No individual's feet are exactly the same. It is found that there is a considerable difference in the feeling, balance, natural alignment and performance of a skier when the alignment of his/her boots are adjusted properly for his/her body's geometry.

Outsoles are known, such as Vibram® outsoles produced by Vibram S.p.A., that are attachable to the sole of a ski boot to adapt the boot for use with a particular binding in a particular type of skiing and to improve the performance of the boot in particular external conditions, for example to provide a greater degree of grip. However, the position of the outsoles cannot be readily adjusted relative to their fasteners once attached to adapt the ski boot to the skier's body as it relates to the ski without their being completely refitted to the sole.

In addition to the foregoing, one of the problems with existing ski boots is their limited adaptability to use in various types of skiing, e.g., downhill, cross-country, ski-jumping, Telemark, etc. In some of these types of skiing, the binding attaches to the ski boot at both the toe and the heel of the boot but in other types, the binding only attaches to the boot at the toe of the boot.

It is an aim of the present invention to provide a ski boot that overcomes the aforementioned problems by allowing adjustment of the alignment of a boot relative to a ski to which it is to be attached and by permitting the boot to be adapted for use with different types of ski bindings. It is a further aim of the present invention to provide a ski boot that can be adapted for use with different types of ski bindings.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Although the word "boot" is used throughout this specification and in the claims, it should be interpreted broadly to include shoes and any form of footwear suitable for wear when skiing.

According to the present invention there is provided a ski boot comprising a sole portion that is attached to one or more separate outsole elements for location between the sole portion and a ski binding, at least one of which outsole elements is adjustably mounted on the sole portion prior to a secure fixing of said outsole element to the sole portion by at least one fastener so as to be adjustable in forward, rearward, lateral and medial directions relative to the sole portion and so as to be rotatable clockwise and counter clockwise relative to a centerline of the boot.

Preferably, at least one of said outsole elements is adapted for attachment to the ski binding.

Preferably also, a plurality of outsole elements is provided, each of which is adjustably mounted on the sole portion so as to be adjustable independently of the other outsoles in forward, rearward, lateral and medial directions relative to the sole portion and that can be rotated clockwise or counter clockwise relative to a centerline of the boot.

Preferably also, the outsole elements comprise a first outsole element located at a toe end of the sole portion. Advantageously, the first outsole element is located in a position anatomically beneath the location of the metatarsal bones of a person wearing the ski boot. This means that the first outsole element is located beneath a ball of the foot of a person wearing the ski boot.

Preferably also, the first outsole element is dished and extends upwardly around the side edges of the sole portion.

Preferably also, the outsole elements comprise a second outsole element located at a heel of the sole portion.

Preferably also, the second outsole element comprises portions for securement to a ski binding.

Preferably also, the outsole elements include a third outsole element comprising a mounting bar for securement to a ski binding. Advantageously, the third outsole element is mounted on the first outsole element and is attached to the sole portion through the first outsole element. However, in some arrangements, an outsole element comprising a mounting bar may be connected directly to the sole portion of the boot.

If only an outsole element at the toe end of the boot is adapted for securement to a ski binding, the ski boot is suitable for use in Nordic skiing. However, if both the first and second outsole elements are adapted for securement to a ski binding, then the ski boot is suitable for use in Alpine skiing where the binding attaches to the ski boot at both the toe and the heel of the boot.

Preferably also, at least one of the outsole elements comprises a first part that is located adjacent the sole portion and one or more second parts that project from the first part and are adapted to contact the ski binding.

Preferably also, the first part and the second part are comprised of materials with a different hardness.

Preferably also, at least one of the outsole elements is canted. The second outsole element may also be is adapted to provide a predetermined heel lift.

Preferably also, each of the outsole elements is secured to the sole portion by it's at least one fastener that passes through an aperture formed in the sole portion.

Preferably also, each of the outsole elements is secured to the sole portion by a pair of fasteners that respectively pass through a pair of apertures formed in the sole portion.

Preferably also, each of said apertures comprises a slot dimensioned so as to permit the outsole element to be adjusted relative to the sole portion in forward, rearward, lateral and medial directions relative thereto.

Preferably also, said apertures are each cruciate in shape.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

The present invention will now be described by way of example with reference to the accompanying drawings, in which like numbers indicate like parts.

DETAILED DESCRIPTION

Figure 1:
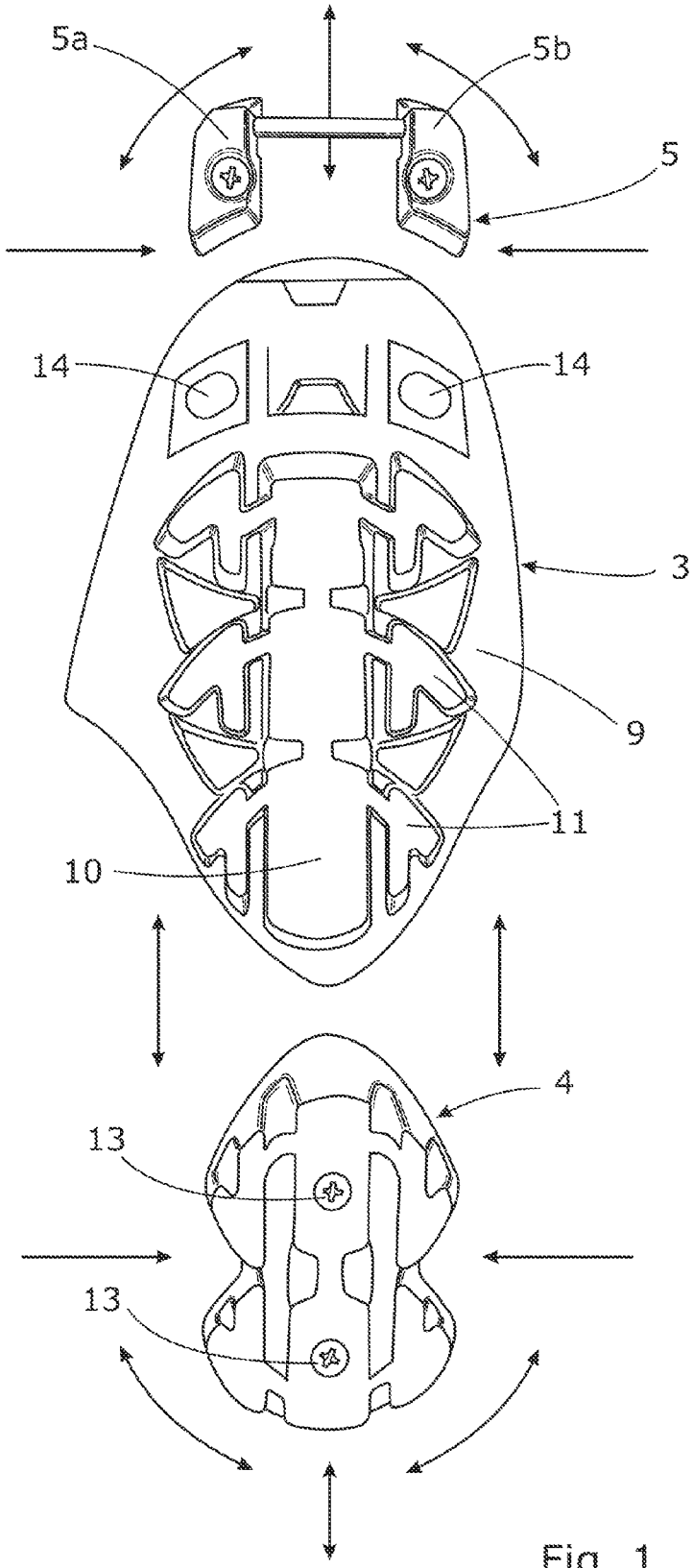
FIG. 1 is an underneath plan view of three outsole elements for connection to a sole of a ski boot in accordance with the present invention
Figure 2:
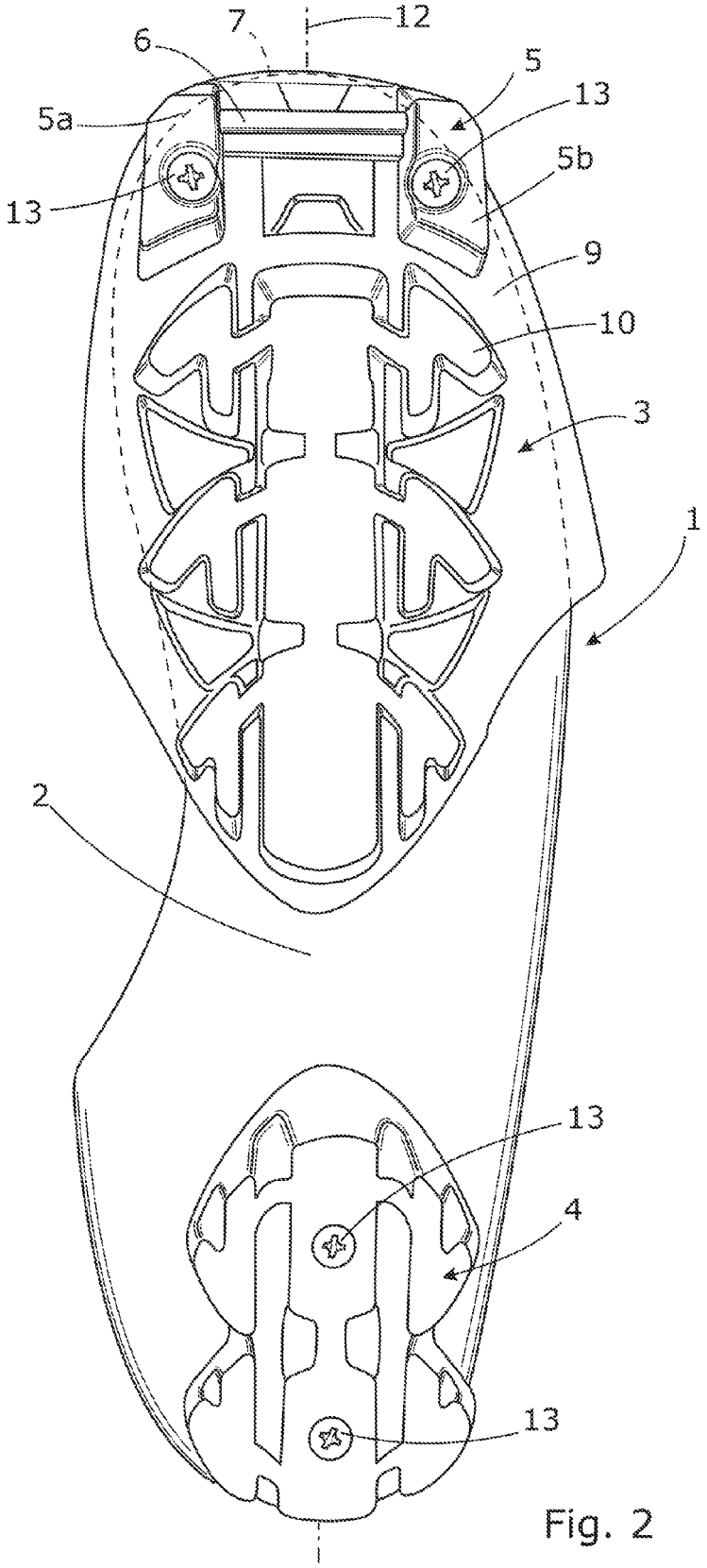
FIG. 2 is underneath plan view of a sole of a Nordic ski boot showing the outsole elements shown in FIG. 1 connected thereto.
Figure 3:
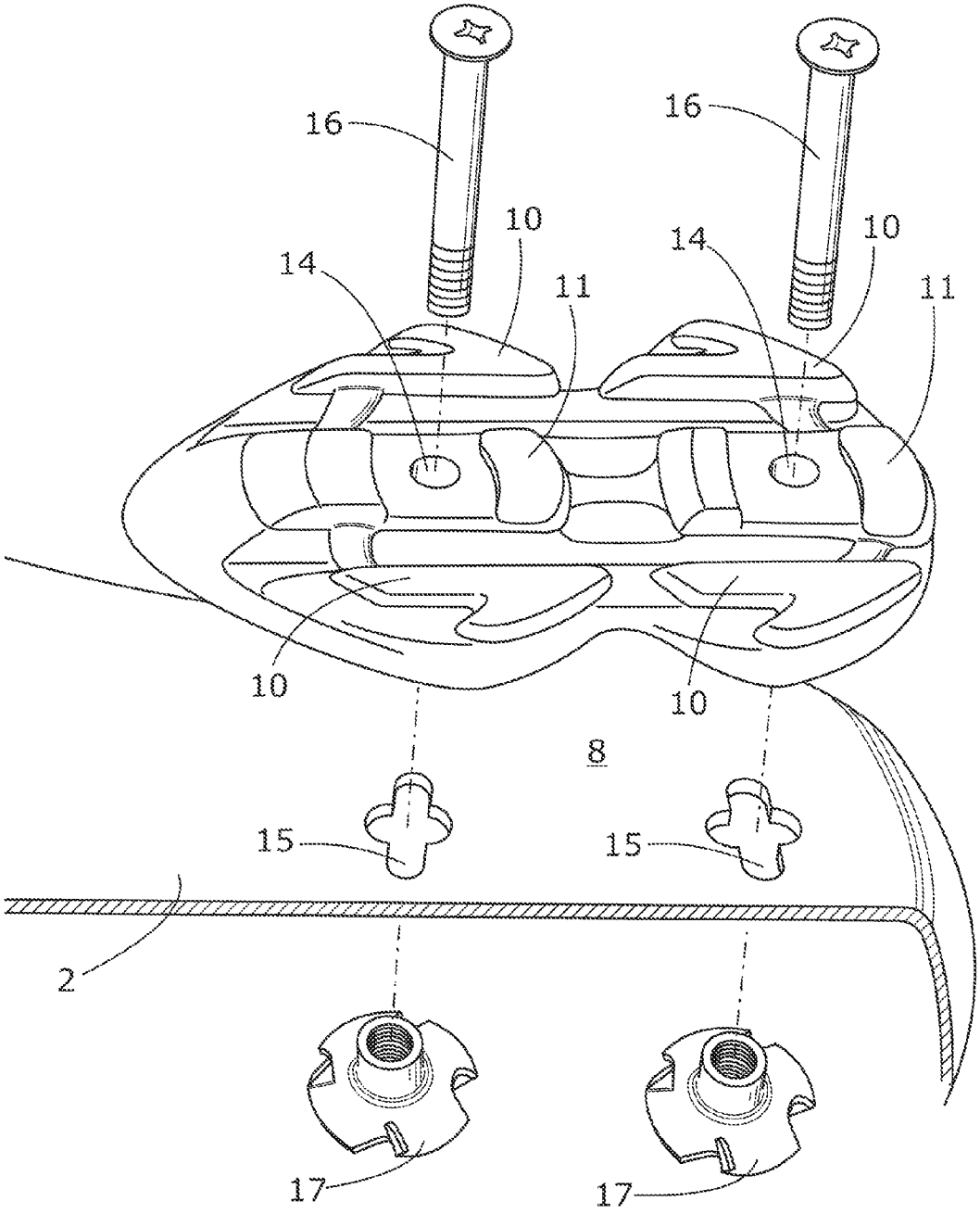
FIG. 3 is an exploded view, in part cross-section, of a heel end of the boot shown in FIG. 2.

The exemplary embodiment illustrated in FIGS. 1-3 shows a Nordic ski boot with a boot upper 1. However, the invention is not limited to such ski boots and by appropriate choice of outsole elements, as described below, a ski boot with a universal boot upper or shell can be adapted for use in various types of skiing, e.g., downhill, cross-country, ski-jumping, Telemark, etc.

The upper 1 is configured to encase a wearer's foot and is equipped with appropriate conventional buckle fasteners (not shown). The present invention is concerned with the sole of the boot and to this end the boot comprises a sole portion 2 that is attached to at least one but in the present example three separate outsole elements 3, 4, 5. These outsole elements 3, 4, 5 locate between the sole portion 2 and a ski binding and least one of them, namely element 5 in the present example, is adapted for attachment to a ski binding and comprises two side portions 5*a*, 5*b* that are secured to the boot and between which is located a mounting bar 6 for securement to a ski binding in a conventional fashion. In other embodiments (not shown), one or more of the other outsole elements 3, 4 may also be adapted for securement to a ski binding in place of or in addition to the outsole element 5. This enables the ski boot to be adapted for use with different types of skis by the incorporation of appropriate projections and the like that connect to or that interact with an appropriate ski binding.

The sole portion 2 comprises a toe end 7 and a heel end 8. The first outsole element 3 is located at the toe end 7 and comprises a front outsole element, and the second outsole element 4 is located at the heel end 8 and forms a heel outsole element for the boot. The front outsole element 3 is dished and extends upwardly around the side edges and toe end 7 of the sole portion 2 of the upper 1. It is larger than the heel outsole element 4 and is located in a position anatomically beneath the location of the metatarsal bones and metatarso-phalangeal joints of a person wearing the ski boot. The ball of the foot is located along the metatarso-phalangeal joints and primarily beneath the head of the first metatarsal bone. Hence, the front outsole element 3 is located beneath the ball of the foot of a person wearing the ski boot. Dependent on the nature of the ski boot, the front outsole element 3 may be made capable of flexing during skiing or be significantly non-flexing by an appropriate choice of the manufacturing material. In all cases, however, the front and heel outsole elements 3 and 4 are made of a resilient material, such as rubber or a similar synthetic material, so as to cushion the foot during skiing. When this material is softer it gives a smoother, softer feeling in the ice conditions. It is also more comfortable during walking before and after skiing, especially on hard surfaces like cement and asphalt. If this material is harder it gives a more stable, direct, rigid contact platform that is an advantage in unstable softer snow conditions.

In some cases, one or both of the front and heel outsole elements 3 and 4 comprises a first part 9 that is located adjacent the sole portion 2 and one or more second parts 10 that project from the first part 9 and that are adapted to contact the ski binding. These second parts 10 may be made in appropriate shapes suitable for the boot in question and comprise projecting ridges 11 and the like. The first and second parts 9 and 10 may be comprised of materials with different thicknesses and hardness so that an appropriate cushioning of the foot within the boot can be achieved. When the height of front and heel outsole elements 3 and 4 is thinner it lowers the skier's center of gravity and reduces the distance the skier is from the ski and the snow. This is better in soft snow conditions and in challenging terrain with steeper up hills. When the height of the front and heel outsole elements 3, 4, 5 is increased the skier is given a greater leverage and power. This is better in fast and icy conditions and on courses with more gradual inclines. In some cases, this increase in leverage is comparable to the increase in leverage that a lifter plate on an Alpine ski provides to the skier.

The front and heel outsole elements 3 and 4 may also have different thicknesses. For example, the heel versus toe height ratio of the boot can be changed by using such outsole elements with different thicknesses. On hills, adjustment of this ratio can produce a large difference in the amount of power and glide a skier has. If a skier prefers to use more of his/her calf muscles then less heel lift is preferred. If a skier prefers to use more of his/her hip and buttock muscles then a higher heel is preferable. The toe and heel lift also moves the skier's hips forward or backward depending on the angle difference. This adjusts the skier's weight position over the ski and enables an optimum position for each person's individual body type, or style to be achieved.

In addition to the foregoing, at least one of the outsole elements 3 and 4 may be canted, the first part 9 and/or the second part 10 being thicker on one side (medial or lateral) of the boot. In addition, the heel outsole element 4 may be adapted to provide a predetermined heel lift. When the outsole elements 3 and 4 are canted they can be used to give a better edge in difficult conditions or to compensate for idiosyncrasies in a skier's body shape and to assist in the achievement of a flatter ski or to get more of an edge if needed.

At least one of the outsole elements 3 and 4 is adjustably mounted on the sole portion 2 prior to its secure fixing to the sole portion 2 so as to be adjustable in forward, rearward, lateral and medial directions relative to the sole portion 2 and so as to be rotatable clockwise and counter clockwise relative to a centerline of the boot. If only one outsole element 3, 4 is adjustably mounted, then it may or may not be adapted for attachment to the ski binding, for example by addition of the third outsole element 5. However, preferably all of the outsole elements 3, 4, 5 are adjustable mounted independently of one another so as to be adjustable in forward, rearward, lateral and medial directions relative to the sole portion 2 and so as to be capable of rotation, at least partially, both clockwise and counter clockwise relative to a centerline 12 of the boot. The adjustability is provided by the way in which the outsole elements 3, 4, 5 are connected to the sole portion 2. Each of the outsole elements 3, 4, 5 is secured to the sole portion 2 by at least one fastener 13 that passes through an aperture 14 in the outsole element and an adjacent aperture 15 formed in the sole portion 2. In the illustrated example, the outsole elements 3 and 4 are each secured by a pair of fasteners 13 that respectively pass through a pair of apertures 15 formed in the sole portion 2. The parts 5*a* and 5*b* of outsole element 5 are also secured by the same fasteners 13 that are used to connect the front outsole element 3 to the sole portion 2, as further described below.

The fasteners 13 can be of any suitable type that clamps the outsole elements 3, 4, 5 to the sole portion 2 when tightened. In the illustrated example, the fasteners 13 comprise screw and nut type fasteners, wherein a screw 16 is inserted through the outsole element 3, 4, 5 from the exterior of the boot and engages a clamping nut 17 located within the boot, as shown in FIG. 3 in relation to the heel outsole element 5. However, other forms of fasteners can be used.

As shown in FIG. 3, the apertures 15 in the sole portion 2 each comprise a slot dimensioned so as to permit the position of the adjacent outsole element 3, 4 to be adjusted relative to the sole portion 2 prior to tightening of the fastener or fasteners 13. Preferably, the apertures 15 in the sole portion 2 are substantially cruciate in shape. This facilitates adjustment of the outsole elements 3, 4 relative to the sole portion 2 in the forward, rearward, lateral and medial directions relative thereto and also facilitates rotation clockwise and counter clockwise relative to the centerline 12. These movements are indicated by the arrows shown in FIG. 1.

The outsole element 5 is also mounted on the front outsole element 3 with some degree of adjustability. As shown in FIG. 1, the apertures 14 in the outsole element 3 are enlarged oval slots. This enables the position of the outsole element 5 to be adjusted relative to its fasteners 13 and to both the front outsole element 3 and the sole portion 2. In particular, suitably sized apertures enable the element 5 to be adjusted relative to the element 3 and thereby the boot laterally, medially, forwards and rearwards and also to be rotatable clockwise and counter clockwise relative to the centerline 12 (or ski centerline) of the boot.

Hence, it will be appreciated that by appropriate choice of the number and placement of outsole elements such as those described above, a skier is able to customize a ski boot to his/her requirements. In particular, in both a Nordic and Alpine ski boot the outsole elements provide a boot outsole that can be adjusted laterally, medially, forwards and rearwards and that can be rotated clockwise and counter clockwise relative to the centerline 12 (or ski centerline) of the boot.

In a Nordic boot, front and heel outsole elements 3 and 4 may be provided that are both independently adjustable relative to the upper 1 in forward, rearward, lateral and medial directions and are also capable of rotation clockwise or counter clockwise relative to the centerline 12 of the boot. This arrangement has the advantage that the outsole elements 3 and 4 can be independently adjusted, removed or replaced from the boot. Hence, elements 3 and 4 of different materials and geometries can be used as desired. Alternatively, a single outsole element could be provided that covers both the front and heel parts of the sole portion 2. Such an element could also be adjustable relative to the sole portion 2 in the same way as the elements 3 and 4 but it will be appreciated that the front and heel portions would not then be independently adjustable. In both cases an independent outsole element 5 may also be used that can be adjusted, removed or replaced, as desired.

Hence, the invention provides a ski boot that allows adjustment of the alignment of the boot relative to a ski to which it is to be attached, enabling the wearer to customize the boot to his/her own requirements. In addition, it enables a universal boot to be adapted to for use with different types of ski bindings.

While illustrative embodiments have been illustrated and described, it will be appreciated that various changes can be made therein without departing from the spirit and scope of the invention.

The embodiments of the invention in which an exclusive property or privilege is claimed are defined as follows:

1. A ski boot comprising a sole portion that is attached to one or more separate outsole elements for location between the sole portion and a ski binding, at least one of which outsole elements is adjustably mounted on the sole portion prior to a secure fixing of said one or more outsole elements to the sole portion by at least one fastener wherein a position of the at least one outsole element on the sole portion is adjustable without engaging the ski binding, the positional adjustability being in at least two of: (i) a forward/rearward direction relative to the sole portion, (ii) a lateral/medial direction relative to the sole portion, and (iii) a clockwise/counterclockwise direction relative to a centerline of the ski boot.

2. The ski boot as claimed in claim 1, wherein at least one of said one or more outsole elements attaches the one or more outsole element to the ski binding.

3. The ski boot as claimed in claim 1, wherein the one or more outsole elements comprise a plurality of outsole elements, each of which is adjustably mounted on the sole portion so as to be adjustable independently of the other outsole elements in the forward/rearward direction, the lateral/medial direction and the clockwise/counterclockwise direction.

4. The ski boot as claimed in claim 1, wherein the one or more outsole elements comprise a first outsole element located at a toe end of the sole portion.

5. The ski boot as claimed in claim 4, wherein the first outsole element is located in a position anatomically beneath the location of the metatarsal bones of a person wearing the ski boot.

6. The ski boot as claimed in claim 4, wherein the first outsole element is dished and extends upwardly around side edges of the sole portion.

7. The ski boot as claimed in claim 1, wherein the one or more outsole elements comprise a second outsole element located at a heel of the sole portion.

8. The ski boot as claimed in claim 7, wherein the second outsole element comprises portions for securement to the ski binding.

9. The ski boot as claimed in claim 1, wherein the one or more outsole elements include a third outsole element comprising a mounting bar for securement to the ski binding.

10. The ski boot as claimed in claim 9, wherein the one or more outsole elements further comprise a first outsole element located at a toe end of the sole portion and wherein the third outsole element is mounted on the first outsole element and is attached to the sole portion through the first outsole element.

11. The ski boot as claimed in claim 1, wherein at least one of the one or more outsole elements comprises a first part that is located adjacent the sole portion and one or more second parts that project from the first part and are adapted to contact the ski binding.

12. The ski boot as claimed in claim 11, wherein the first part and the one or more second parts are comprised of materials with a different hardness.

13. The ski boot as claimed in claim 1, wherein at least one of the one or more outsole elements is canted.

14. The ski boot as claimed in claim 1, wherein at least one of the one or more outsole elements provides a predetermined heel lift.

15. The ski boot as claimed in claim 1, wherein each of the one or more outsole elements is secured to the sole portion by at least one fastener that passes through an aperture formed in the sole portion.

16. The ski boot as claimed in claim 1, wherein each of the one or more outsole elements is secured to the sole portion by a pair of fasteners that respectively pass through a pair of apertures formed in the sole portion.

17. The ski boot as claimed in claim 15, wherein the aperture comprises a slot dimensioned so as to permit the one or more outsole elements to be adjusted relative to the sole portion in the forward/rearward and the lateral/medial directions.

18. The ski boot as claimed in claim 17, wherein the aperture is substantially cruciate in shape.

* * * * *